United States Patent [19]

Seitz

[11] 4,362,475

[45] Dec. 7, 1982

[54] COMPRESSOR INLET VALVE

[75] Inventor: William R. Seitz, La Porte, Ind.

[73] Assignee: Joy Manufacturing Company, Pittsburgh, Pa.

[21] Appl. No.: 243,828

[22] Filed: Mar. 16, 1981

[51] Int. Cl.[3] ..... F04B 49/00; F16K 31/143; F16K 31/383; F15B 15/27

[52] U.S. Cl. ..... 417/295; 91/25; 251/63.6

[58] Field of Search ..... 417/279, 295; 251/63.6; 137/516.17; 91/25, 26

[56] References Cited

U.S. PATENT DOCUMENTS

| | | | |
|---|---|---|---|
| 2,241,195 | 5/1941 | Gehres | 230/21 |
| 2,241,330 | 5/1941 | Shaw | 230/21 |
| 3,348,764 | 10/1967 | Romerhaus | 230/22 |
| 3,593,959 | 7/1971 | Greene | 251/63.6 |
| 3,613,719 | 10/1971 | Bauer | 137/522 |
| 3,632,231 | 1/1972 | Bloom | 417/295 |
| 3,656,708 | 4/1972 | Hobbs | 251/63.6 |
| 4,085,772 | 4/1978 | Roger | 137/464 |
| 4,194,534 | 3/1980 | Lawrence | 251/63.6 |
| 4,315,716 | 2/1982 | Backer | 417/295 |

*Primary Examiner*—John J. Camby

[57] ABSTRACT

A compressor having an inlet valve which includes a valve housing and a control tube having a portion adapted to be in communication with a source of fluid. A piston is normally spring biased away from a valve element which is adapted to be alternately placed in sealing contact with a valve seat and withdrawn from such contact. The piston and valve element are movably mounted on the exterior of the control tube. Orifices in the control tube are adapted to control movement of the piston against the bias of the spring and also to provide a modulating influence as well as additional pressure balancing characteristics. The valve is also adapted to function as a bypass valve, a check valve and a blowdown function.

30 Claims, 3 Drawing Figures

COMPRESSOR INLET VALVE

BACKGROUND OF THE INVENTION

1. Field of the Invention

This invention relates to a compressor inlet valve construction and, more specifically, such a valve wherein multiple functions are accomplished through a control tube which transmits fluid to the valve housing interior.

2. Description of the Prior Art

In connection with various types of compressor designs, a wide variety of valve constructions have been employed. See, for example, U.S. Pat. Nos. 2,241,195; 2,241,330; 3,348,764; 3,595,959 and 3,613,719.

In general, the prior art designs have been somewhat complex and frequently provide only a single purpose valve.

U.S. Pat. No. 2,241,195 discloses an unloading mechanism wherein a piston is adapted to contact a plunger which in turn operates through a spring biased spider-collar combination to move a poppet valve.

U.S. Pat. No. 2,241,330 discloses a fluid pressure operated valve arrangement which provides a number of clearance pockets in association with a compressor cylinder.

U.S. Pat. No. 3,348,764 discloses pressure equalizing means for a compressor wherein a gravity biased valve element is adapted, responsive to certain changes in pressure, to permit communication between the compressor inlet and outlet.

U.S. Pat. No. 3,593,959 discloses a pocket unloader valve wherein a piston is operated by pneumatic pressure introduced into the cylinder and overcomes the bias of a spiral spring so as to act upon the valve element.

U.S. Pat. No. 3,613,719 discloses a compressor valve wherein a hollow control piston is adapted to raise a valve plate through the lifting of interposed spheres.

There remains, therefore, a very real and substantial need for a compressor inlet valve which is of relatively simple construction and operation and will provide multiple functions.

SUMMARY OF THE INVENTION

The present invention has met the above-described need. The compressor inlet valve of the present invention employs fluid pressure as one means for operating the valve to alternately permit and restrict intake into the compression chamber. In addition, the valve is is adapted to serve as a check valve in case of accidental shutdown. Also, a bleeder capability is provided through a bypass in order to relieve certain shock loading. Further, a portion of the fluid flow through the valve is delivered to the inlet side of the valve to lower the system pressure for low unloaded horsepower.

The compressor valve has a valve housing, a control tube disposed at least partially within the housing and a first portion adapted to be in communication with a source of fluid. A valve element is mounted on the control tube for relative movement thereon, as is a piston which is disposed between the valve element and the control tube first portion. Valve seat means are provided. Main spring means bias the piston generally toward the control tube first portion.

First orifice means receive fluid from the control tube first portion and discharge at least a portion thereof to the housing interior in such position as to urge movement of the piston against the main spring means so as to move the valve element to closed position. Second orifice means may be provided to cooperate with the piston bore which preferably has a counterbore or radially enlarged portion in such fashion that with the piston in a first position, fluid will not emerge from the second orifice means and with the piston in a second position, fluid will emerge from the second orifice means so as to provide a modulating effect by providing a slight increase of fluid flow into the valve housing interior. Third orifice means may be positioned on the inlet side of the valve seat so as to assist with reduction in pressure differential across the valve seat.

The piston may have a piston head provided with one or more passageway means so as to permit bleeding action across the piston to relieve sudden shock loading. Also, the valve element is adapted to be moved independently of the piston and to function as a check valve in the event of accidental shutdown of the compressor.

It is an object of the present invention to provide a compressor inlet valve construction which is adapted to not only alternately shut off and permit flow of fluid to the compression chamber, but also to provide additional valve functions.

It is a further object of the invention to provide such a valve which also may function as a check valve.

It is a further object of this invention to provide such a valve which includes bypass and bleeding means so as to resist potentially hazardous and potentially equipment damaging events.

It is another object of the present invention to provide such a valve inlet construction which may employ the compressor as a source of valve operating fluid.

It is yet another object of the invention to provide such an inlet valve construction which is of simple and efficient design, as well as being economical to manufacture and employ.

These and other objects of the invention will be more fully understood from the following description of the invention on reference to the illustrations appended hereto.

DESCRIPTION OF THE PREFERRED EMBODIMENTS

Figure 1:
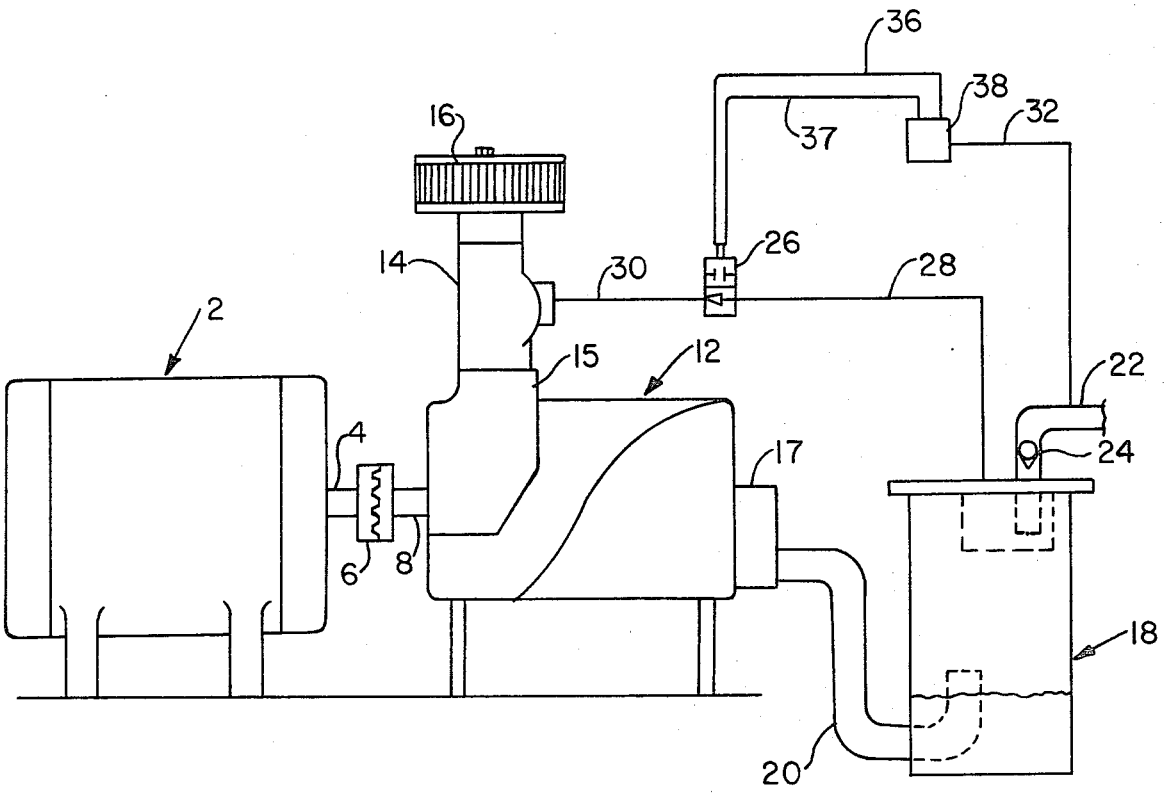
FIG. 1 is a partially schematic illustration of a form of compressor arrangement adapted for use with the present invention.

There is shown a motor 2 which has output shaft 4 coupled to compressor input shaft 8 through coupling 6. If desired, a suitable gear box for speed reduction may be provided. The compressor 12 may be a screw compressor, reciprocating compressor or any other type of compressor wherein the inlet valve to be described hereinafter could be employed advantageously. Inlet valve 14 cooperates with compressor 15 and overlying air filter 16 to provide a source of filtered air to the compressor. Compressor outlet 17 is connected to receiver 18 through pipe 20. Oil separated from the pressurized air accumulates in the oil sump of receiver 18 and is removed for filtering and recirculation by any conventional means (not shown). Pressurized air emerges from receiver 18 through pipe 22 which has a check valve 24 for resisting undesired reverse flow.

As will be described hereinafter, in a preferred embodiment of the invention, a portion of the pressurized air or other gas emerging from receiver 18 is introduced into inlet valve 14 through lines 28, 30. In the form shown, a two-position solenoid valve 26 serves to provide or cut off flow of pressurized air to the inlet valve 14. Pressure regulator 38 cooperates with air line 32 which is connected to pipe 22 and a pair of lines 36 and 37 which are connected to solenoid valve 26.

Figure 2:
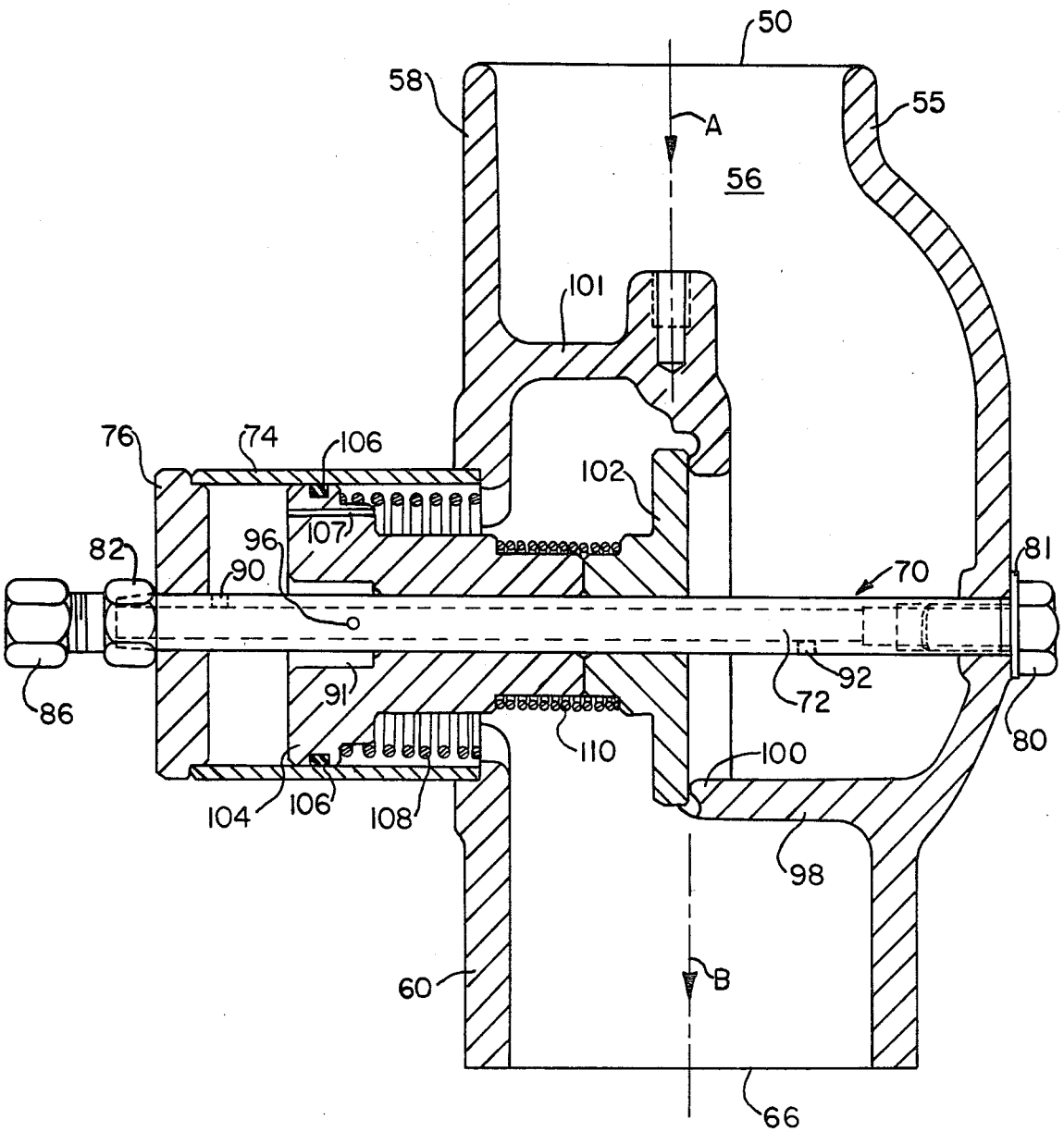
FIG. 2 is a cross sectional illustration of a preferred form of inlet valve construction of the present invention showing the valve element in closed position.

A detailed cross sectional view of the inlet valve (reversed as to orientation with respect to the direction shown in schematic FIG. 1) is shown in FIG. 2. The valve has an inlet end 50 through which fluid, such as gas or air, enters in the direction generally indicated by the arrow A and an outlet end 66 which leads to the interior of the compressor and has fluid flow in the direction indicated generally by the arrow B.

The housing, in the form shown, includes a first housing element 55 which cooperates with housing element 58 to define inlet region 56. The outlet region is defined, in part, by housing element 55 in cooperation with sector 60. It will be appreciated that these housing components 55, 58, 60 may be formed either as a unit or assembled from individual component parts to establish a unitary construction. The housing has a generally cylindrical projection 74 which has an end wall 76.

A hollow control tube 70 in the form shown, extends entirely through the housing and is secured in position by fasteners 80, 82 which may advantageously be threadedly secured to the exterior of the control tube 70. Washer 81 is interposed between fastener 80 and housing wall 55. A portion of the control tube 70 projects outwardly beyond fastener 82 and is provided with fitting or first portion 86 through which a valve operating fluid may be introduced into the control tube 70, as by line 30 shown in FIG. 1. It will be appreciated, however, that if desired, although less preferred, an independent source of fluid may be provided for introduction into this first portion of control tube 70.

Referring still to FIG. 2, a ledge 98 extends generally inwardly from housing element 55 and a ledge 101, having a downward extension, projects inwardly from housing element 58. The free ends of these ledges 98, 101 cooperate to define an annular, continuous valve seat 100.

Valve element 102, which has an enlarged head portion, engaged with valve seat 100 and a reduced diameter portion at its opposed ends, is of generally circular configuration and is adapted to resist flow of air into the compressor when the valve is in the position shown in FIG. 2, i.e., in intimate contact with the valve seat 100. Valve element 102 is mounted on the exterior of control tube 70 and is adapted for relative sliding movement therealong.

Piston 104 is also mounted on control tube 70 and is adapted for relative sliding movement therealong. The piston 104 is interposed between the valve element 102 and the fitting or first portion 86 where fluid is introduced into the hollow bore 72 of control tube 70. The piston 104 has an enlarged head portion at the end remote from the valve element 102 and is in intimate contact with the interior of cylinder 74. Annular seal 106 is adapted to resist undesired flow of fluid between the cylinder 74 and the piston 104.

The piston 104 has an axial bore of a first relatively small diameter over a major portion of its axial extent and a radially enlarged portion 91 which in the form shown, is positioned generally in the region of the enlarged head of piston 104. In the form shown, the enlarged head has a passageway 107 therethrough to permit bleeding of a portion of the fluid entering to the left of the piston.

Figure 3:
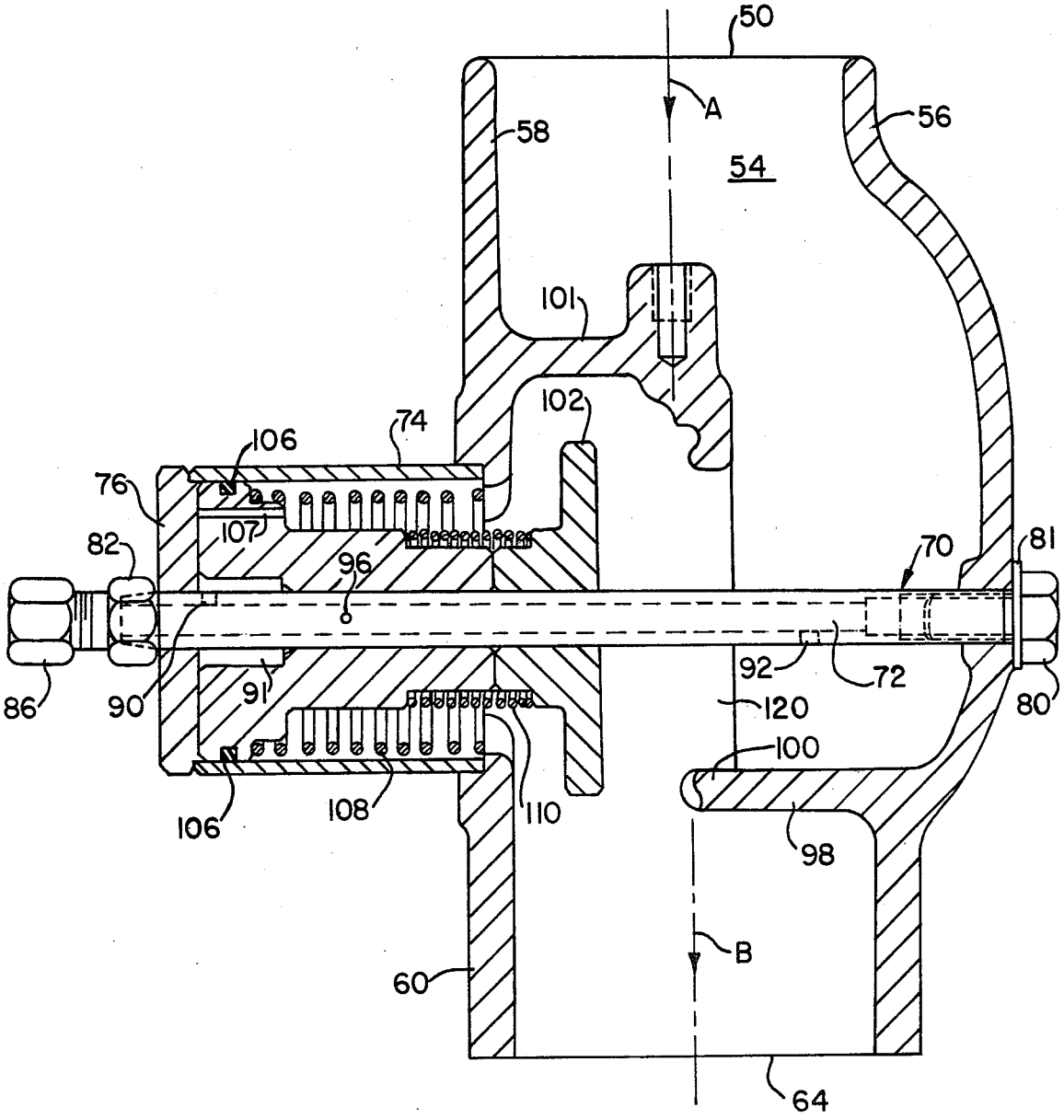
FIG. 3 is a cross sectional illustration of the valve shown in FIG. 3 with the piston and valve element shown in valve-open position.

Referring once again to FIG. 2 and the control tube 70, it is noted that it has a hollow axial bore 72. First orifice means 90 communicate with the bore 72 and is adapted to deliver a portion of the fluid entering the control tube bore 72 through fitting 86 to the region between the piston 104 and the cylinder end wall 76. Prior to the introduction of the fluid, the piston is positioned under the influence of main spring 108 generally in contact with end wall 76 as is shown in FIG. 3. Fluid entering the control tube 70 emerges through orifice 90 in order to urge the piston to travel along the control tube 70 to the right as shown in FIGS. 2 and 3. The piston 104 ultimately contacts valve element 102. This serves to move the valve element 102 into contact with the valve seat 100 so as to close the valve. While a single orifice 90 in communication with the interior of the valve housing and the bore 72 of control tube 70 is illustrated, it will be appreciated that additional orifices may be employed if desired. It is noted that the initial flow of fluid into the valve interior through orifice 90 will be received within the enlarged piston bore 91.

Second orifice means 96 in communication with the control tube bore 72 are axially displaced from first orifice means 90. These orifices means 96 which may take the form of one or more orifices disposed generally at the indicated axial position are adapted to be open so as to permit flow of fluid from the control tube bore 72 into annular radially enlarged bore sector 91 when the piston is in such position that the enlarged portion 91 is aligned with the second orifice means 96 as is shown in FIG. 2 and to be closed by the reduced diameter portion of the piston bore when the piston is in a position such that the second orifice means 96 are aligned with the reduced bore such as is shown in FIG. 3. It will be appreciated, that in this fashion, as the piston travels from left to right, in the form shown in FIGS. 2 and 3, under the influence of fluid emerging from first orifice means 90 when the enlarged bore portion 91 becomes aligned with second orifice means 96, increased flow of the fluid in the zone defined by cylinder 74, end wall 76 and the piston head will be achieved. This serves to provide an additional control function as the speed with which the piston moves from left to right against the bias of main spring 108 is modulated by flow through both orifice means 90, 96.

It is noted that passageway 107 permits flow of a relatively small volume of fluid from one side of the piston head 104 to the other. This facilitates bleeding of fluid after the piston 104 has moved the valve 102 to the closed position so as to avoid undesired excess pressure differential buildup within the chamber to the left of the piston, as it communicates with the compressor.

Third orifice means 92, which may take the form of one or more orifices, in communication with bore 72 are positioned to the right of valve seat 100. Some of the fluid supplied through control tube first portion fitting 86 will be discharged on the inlet side of the valve seat in order to bleed a portion of sump fluid for low unload horsepower. As is true with all of the orifice means, it is contemplated that one or more circumferentially spaced orifices in communication with the internal bore 72 will preferably be provided at generally the same axial position on the control tube or the functional equivalent thereto. It will be appreciated, that some departure from this axial alignment with respect to a given orifice means is permitted while retaining the functional benefits of the particular orifice means.

As is shown in FIGS. 2 and 3, a helper spring 110 is of substantially uniform diameter and engages generally cylindrical portions of the valve elements 102 and the piston 104. This serves to assist with coordinating movement of the valve element 102. One of the features of the invention contemplates the valve element 102 serving as a check valve to preclude undesired reverse flow from the compressor side of the valve to the inlet sector 56. When the valve element 102 functions as a check valve, the valve element 102 may move to the right with the piston 104 remaining substantially unmoved with a portion of the exterior of the control tube 70 being exposed between the piston 104 and valve element 102. Spring 110 will tend to move valve element 102 into contact with valve seat 100 in a normal rest condition or during accidental shutdown. The valve element 102 will become unseated and open against the bias of spring 110 automatically during compressor operation due to the pressure differential across valve seat 100.

As was shown in FIG. 1, as a result of the fluid entering through control tube first portion fitting 86 from the high pressure side of the compressor, during blowdown air may be released through the inlet passageway 54 through flow out of third orifice means 92.

It will be appreciated, therefore, that the present invention contemplates a simple, multifunction compressor inlet valve which is adapted to be operated by fluid means. Not only does the control tube provide a source of fluid for moving a piston against the bias of a spring into contact with a valve element which is seated, but additional orifice means are provided to regulate movement of the piston and valve and also to achieve pressure balancing effects.

Further, the valve element is adapted to move along the tube element either under the influence of the piston or the pressure differential or the helper spring or all three. It can, therefore, function as a check valve. Also, in a preferred embodiment one orifice means serves as a means for exhausting the compressor during blowdown. The piston means is also provided with suitable bleeder means such as passageway 107, in order to serve as a fluid bypass to prevent load, unload shock and noise. Also, as the source of fluid may be the compressor outlet, this eliminates the need for a separate source of fluid, which may be employed, if desired, and also permits the blowdown advantage mentioned above.

While for simplicity of reference herein, the valve has been described generally as being operated by fluid, it will be appreciated that in general the fluid will be air or gas.

Whereas particular embodiments of the invention have been described above for purposes of illustration, it will be appreciated by those skilled in the art that numerous variations of the details may be made without departing from the invention as described in the appended claims.

I claim:

1. A compressor inlet valve comprising a valve housing, a control tube disposed at least partially within said housing and having a first portion adapted to be in communication with a source of fluid, valve element means disposed within said housing and mounted on said control tube for relative movement thereon, valve seat means disposed within said housing for cooperating with said valve element in opening and closing said valve, piston means disposed within said housing mounted on said control tube for relative movement thereon, said piston means being interposed between said control tube first portion and said valve element, main spring means for biasing said piston generally toward said control tube first portion, and first orifice means formed in said control tube adjacent to said piston, whereby at least a portion of the fluid introduced into said control tube first portion will emerge through said first orifice means and urge said piston to move against the bias of said main spring means in order to move said valve element to a closed position.

2. The compressor inlet valve of claim 1 including a portion of said housing providing a cylinder within which said piston is adapted to reciprocate.

3. The compressor inlet valve of claim 2 including second orifice means formed in said control tube at a position axially displaced from said first orifice means for delivering a part of the fluid introduced into said control tube first portion to said piston to urge said piston to move against the bias of said main spring means to move said valve element to a closed position.

4. The compressor inlet valve of claim 3 including said piston having an enlarged head portion and a reduced portion, and said piston head being disposed closer to said control tube first portion then to said valve element.

5. The compressor inlet valve of claim 4 including said piston having an axial bore through which said control tube passes, at least a portion of said bore within said piston head being radially enlarged, said second orifice means being closed by the radially smaller portion of said piston bore when said piston is positioned by said main spring means, and said second orifice means being open for flow of fluid therethrough when fluid flowing through said first orifice means has moved said piston sufficiently to align said second orifice means with said enlarged bore portion, whereby exposure of said second orifice means will increase the volume of fluid flow into said housing.

6. The compressor inlet valve of claim 5 including said control tube passing through the opening defined by said valve seat.

7. The compressor inlet valve of claim 6 including third orifice means disposed in said control tube axially displaced from said first and second orifice means.

8. The compressor inlet valve of claim 7 including said third orifice means disposed on the opposite side of said valve seat means from said first and second orifice means.

9. The compressor inlet valve of claim 5 including said valve element means having an enlarged head portion adapted to contact said valve seat and a reduced portion adapted to contact said piston.

10. The compressor inlet valve of claim 9 including helper spring means connecting said piston to said valve element means.

11. The compressor inlet valve of claim 1 including said control tube being substantially straight.

12. The compressor inlet tube of claim 1 including said first control tube portion projecting outwardly from said housing.

13. The compressor inlet tube of claim 10 including said valve element means so mounted on said control tube as to be movable therealong toward said valve seat under the influence of said piston or by pressure differential across valve seat or by said helper spring means.

14. The compressor inlet valve of claim 9 including annular seal means on said piston head for resisting passage of fluid between said piston head and said cylindrical portion of said housing.

15. The compressor inlet valve of claim 9 including passageway means radially displaced from said piston bore passing through said piston head.

16. A compressor comprising a compression chamber, inlet means for receiving fluid to be compressed, outlet means for discharging compressed fluid from said compressor, an inlet valve operatively associated with said inlet means, a valve housing, a control tube disposed at least partially within said valve housing and having a first portion in communication with a source of fluid, valve element means disposed within said valve housing and mounted on said control tube for relative movement thereon, valve seat means disposed within said housing for cooperating with said valve element means in opening and closing said valve, piston means disposed within said housing mounted on said control tube for relative movement thereon, said piston means being interposed between said control tube first portion and said valve element, main spring means for biasing said piston towards said control tube first portion, first orifice means formed in said control tube adjacent to said piston, whereby at least part of the fluid introduced into said control tube first portion will emerge through said first orifice means and move said piston against the bias of said main spring means to urge said valve element to a closed position, and conduit means for introducing a portion of said compressed fluid into said control tube first portion.

17. The compressor of claim 16 including control valve means operatively associated with said conduit means for alternatively restricting or permitting flow to said control tube first portion.

18. The compressor of claim 17 wherein said control valve means include solenoid means.

19. The compressor of claim 18 including pressure regulating means operatively associated with said conduit means.

20. The compressor of claim 16 including second orifice means formed in said control tube at a position axially displaced from said first orifice means for delivering a portion of fluid introduced into said control tube first portion to said piston to urge it to move against the bias of said main spring means to urge said valve element to a closed position.

21. The compressor of claim 20 including said piston having an enlarged head portion and a reduced portion, and said piston head being disposed closer to said control tube first portion than to said valve element.

22. The compressor of claim 21 including said piston having an axial bore through which said control tube passes, at least a portion of said bore within said piston head being radially enlarged, said second orifice means being closed by the radially smaller portion of said piston bore when said piston is positioned by said main spring means, and said second orifice means being open for flow of fluid therethrough when fluid flowing through said first orifice means has moved said piston sufficiently far to align said second orifice means with said enlarged piston bore portion, whereby exposure of said second orifice means will accelerate the volume of fluid flow into said housing.

23. The compressor of claim 22 including said control tube passing through the opening defined by said valve seat, and third orifice means disposed in said control tube axially displaced from said first and second orifice means.

24. The compressor of claim 23 including said third orifice means disposed on the opposite side of said valve seat means from said first and second orifice means.

25. The compressor of claim 24 including said valve element means having an enlarged head portion adapted to contact said valve seat and a reduced portion adapted to contact said piston.

26. The compressor of claim 25 including helper spring means connecting said piston with said valve element means.

27. The compressor of claim 26 including said control tube being substantially straight, and said control tube first portion projecting outwardly from said housing.

28. The compressor of claim 27 including said valve element means so mounted on said control tube as to be movable therealong toward said valve seat under the influence of said piston or by pressure differential means across said valve seat or by said helper spring means.

29. The compressor of claim 28 including annular seal means on said piston head for resisting passage of fluid between said piston head and said cylindrical portion of said housing.

30. The compressor of claim 24 including passageway means extending through said piston head.

* * * * *